US011957971B2

(12) United States Patent
Leeman

(10) Patent No.: US 11,957,971 B2
(45) Date of Patent: Apr. 16, 2024

(54) PLAYSET WITH INTEGRATED WORKOUT STATIONS

(71) Applicant: Brad Alan Leeman, Lusby, MD (US)

(72) Inventor: Brad Alan Leeman, Lusby, MD (US)

(73) Assignee: Brad Alan Leeman, Lusby, MD (US)

( * ) Notice: Subject to any disclaimer, the term of this patent is extended or adjusted under 35 U.S.C. 154(b) by 73 days.

(21) Appl. No.: 17/385,689

(22) Filed: Jul. 26, 2021

(65) Prior Publication Data

US 2021/0387036 A1 Dec. 16, 2021

Related U.S. Application Data

(60) Provisional application No. 63/033,984, filed on Jun. 3, 2020.

(51) Int. Cl.
*A63B 9/00* (2006.01)

(52) U.S. Cl.
CPC ..... *A63B 9/00* (2013.01); *A63B 2009/006* (2013.01); *A63B 2208/12* (2013.01)

(58) Field of Classification Search
CPC ..... A63B 17/04; A63B 9/00; A63B 2009/006; A63B 2208/12
See application file for complete search history.

(56) References Cited

U.S. PATENT DOCUMENTS

| | | | | |
|---|---|---|---|---|
| 4,278,250 | A * | 7/1981 | Baynes | A63B 17/00 482/34 |
| D330,579 | S * | 10/1992 | Briggs | A63G 31/007 D21/822 |
| 6,283,871 | B1 * | 9/2001 | Briggs | A63G 31/00 124/16 |
| 8,002,642 | B2 * | 8/2011 | Guerzini | A63G 31/00 482/35 |
| 9,114,271 | B1 * | 8/2015 | Brown | A63B 23/0458 |
| D807,978 | S * | 1/2018 | Keller | D21/814 |
| 2007/0032357 | A1 * | 2/2007 | Piane, Jr. | A63B 69/222 482/142 |
| 2010/0075565 | A1 * | 3/2010 | Kaczmarek | A63B 23/03541 482/129 |
| 2013/0178299 | A1 * | 7/2013 | Kopp | A63G 9/00 472/136 |
| 2018/0028852 | A1 * | 2/2018 | Beaver | A63B 71/0036 |
| 2020/0254298 | A1 * | 8/2020 | Innocenzi | A63B 23/1209 |
| 2021/0162251 | A1 * | 6/2021 | Mullen | A63B 17/00 |
| 2021/0170218 | A1 * | 6/2021 | Lewis-Dove | A63B 17/04 |

FOREIGN PATENT DOCUMENTS

| | | | |
|---|---|---|---|
| AU | 2021104530 | A4 * | 9/2021 |
| CA | 3000075 | A1 * | 10/2019 |

* cited by examiner

*Primary Examiner* — Joshua T Kennedy

(57) ABSTRACT

A fitness-based playset with integrated exercise equipment allowing parents or other adults to play alongside their children. The play equipment may include a slide, swings, play deck, and other various climbing apparatus. The exercise equipment may include pull-up bars, dip bars, box jumps, core training station, squat rack, and climbing rope. The equipment has a modular design which allows one or more pieces to be connected to or removed from the main structure to provide various configurations.

9 Claims, 10 Drawing Sheets

PLAYSET WITH INTEGRATED WORKOUT STATIONS

FIELD

The embodiments of the present application in general relate to exercise equipment and playset and playground equipment for children and adults to use.

BACKGROUND OF THE INVENTION

Playsets and playgrounds currently available on the market are targeted for children's use only; there are no parts designed specifically for adults to use and enjoy. Despite the fact that parents are nearly always present with their young children when using the backyard playset or public playground, activities for adults are not integrated.

Time spent playing on a backyard playset or on a public playground is an excellent time for parents to set a positive example for their children. As George Bernard Shaw said: "We don't stop playing because we grow old; we grow old because we stop playing."

Interest in strength, conditioning, and overall fitness has increased in popularity in recent years, as has the prevalence of home gym equipment. Typical home gym equipment includes pull-up bars, racks, box jumps, barbells, dumbbells, kettlebells, and resistance bands. Most home fitness equipment currently available on the market is designed to be used indoors.

Existing playsets and playground equipment provide features for children to play and exercise, but they do not provide the opportunity for parents to play and exercise alongside their children or for adults to use the equipment when children are not present.

Conventional playset and playground equipment is frequently constructed from materials such as wood, metal, or composite materials. Playset and playground equipment constructed from wood must generally be treated or finished before use. Disadvantageously, the wood may deteriorate over time, even if the wood is frequently repainted or refinished. If the wood deteriorates, it may pose a safety hazard and need to be replaced, a difficult, time-consuming, and costly task.

Conventional playset and playground equipment is not easily disassembled and reassembled in another location, at a family's new home for example. To achieve adequate rigidity and strength, conventional playset and playground equipment is either 1) required to be permanently affixed to the ground using concrete or 2) the materials used to construct the playset or playground equipment (such as wood) are not durable and long-lasting enough to accommodate reassembly in a different location. For example, once screws or lag bolts are removed from structural members made of wood, they are not as secure when reassembled.

Furthermore, conventional playset and playground equipment is not designed to adapt to children and their changing play and exercise interests as they age. Conventional equipment contains features that appeal to relatively narrow age groups, thus making the playset or playground equipment obsolete and of little interest or use after only a few years.

SUMMARY OF THE INVENTION

This fitness-based playset is designed with all the standard features of a playset or playground equipment (slide, swings, play deck, climbing apparatus), while seamlessly integrating exercise stations to accommodate typical body weight exercises associated with high-intensity interval training. The integrated exercise stations are primarily targeted for adult use, but they may also be rendered safe for children. By directly integrating workout equipment into an outdoor playset, children and adults can play together and parents set a positive role model for children by demonstrating a healthy lifestyle. Workout stations seamlessly integrated into the playset include various sizes of box jumps, various sizes of pull-up bars, dip bars, squat rack, sit-up station, a core training station, and resistance band training. The playset is designed to be assembled in a modular fashion to allow the addition of play equipment or workout gear that adapts as the children's play and exercise interests change over time.

The primary structure of this playset equipment may be constructed of metal. Metal construction provides a high level of durability and rigidity to allow children and adults to use the playset simultaneously. Significantly, the metal construction may also be able to support a large amount of force or weight, and the metal components may require very little maintenance or repair. Unlike wood, metal construction will not rot in the outdoor elements, nor will it be susceptible to destructive insect infestation.

All major metal components of the playset equipment may be coated to increase durability and comfort of use. The coating is preferably a non-slip polymer variety which may allow the equipment to be generally weather resistant and temperature insensitive.

One aspect is equipment of a durable and rigid construction with pre-drilled holes and consistently sized hardware that may make the playset equipment easier to disassemble and reassemble in another location. Furthermore, the structure may be designed to allow earth anchors to be inserted through an opening in the foot of structural members to easily and securely anchor the equipment in a variety of soil types without the need for permanent concrete footers.

Another aspect is playset equipment that may include a variety of different types of equipment, components, and pieces. For example, the playground equipment may include a main structure that may include a platform and it may be raised above the ground. The main structure may also include railings, a roof, walls, and the like. Additional equipment, components, and pieces may be attached to the main structure in a variety of embodiments.

Another aspect is playset equipment that may include a variety of climbing apparatus such as ladders, stairs, climbing walls, climbing ropes, monkey bars, and the like. These climbing apparatus may be permanently affixed to the structure or removable.

Yet another aspect is playset equipment that may include one or more components constructed from plastic. For example, a slide, climbing wall, or swing seat may be constructed from plastic. The plastic components are preferably constructed using a rotomolding process, which may allow lightweight components to be formed and it may allow the components to have various desired configurations, shapes, and sizes. This may also allow components to be constructed that are generally weather resistant and temperature insensitive, which may allow the equipment to be used in a wide variety of locations and environments. In addition, this may allow components that are durable, long-lasting, and corrosion resistant to be constructed. Further, because components constructed from molded plastic may be relatively strong, these components may be used to support a relatively large amount of weight.

Still another aspect is playset equipment that may include one or more swings. The swing may include a seat and one or more tethers, such as chains, ropes, cables, or the like, attached to the seat. The swing seat may include one or more portions constructed from a relatively lightweight rigid material, such as plastic, preferably using a rotomolding or other suitable manufacturing process. The seat may also include a frame, which may be sized and configured to reinforce the molded portions of the seat. For example, the frame may include one or more supports, which may be connected to the molded portions of the seat. The swing seat may have integrated handles to allow the seat to be used additionally for core training exercises.

A further aspect is exercise equipment, designed for adult use, that may include a variety of types of equipment, components, and pieces. For example, the integrated exercise equipment may include pull-up bars, dip bars, box jumps, squat rack, a core training station, a rope climb, and a variety of appropriate places from which to attach suspension exercise systems, landmine equipment, moveable barbell holders, safety spotter arm equipment, pulley systems, and other various equipment. The metal construction may allow a rigid and sturdy structure capable of supporting the weight of an adult.

BRIEF DESCRIPTION OF THE DRAWINGS

The appended drawings contain figures of preferred embodiments to further illustrate and clarify the above and other aspects, advantages, and features of the present invention. It will be appreciated that these drawings depict only preferred embodiments of the invention and are not intended to limit its scope. These and other features and advantages of the present invention will become more readily appreciated when considered in connection with the following detailed description and appended drawings, wherein.

DETAILED DESCRIPTION OF THE INVENTION

Figure 1:
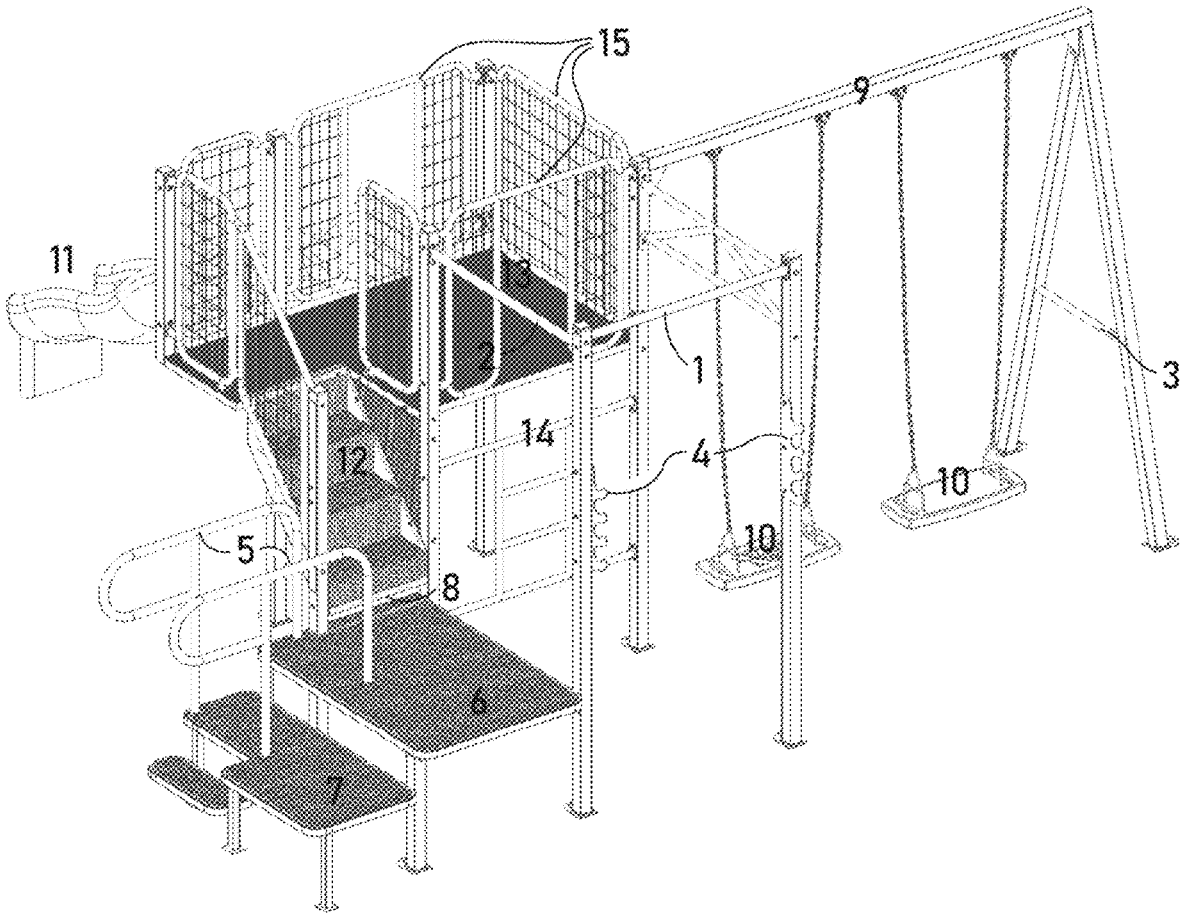
FIG. 1 is a front perspective view of an exemplary embodiment of the fitness-based playset equipment with integrated play features and workout stations, with workout equipment labeled as such.
Figure 2:
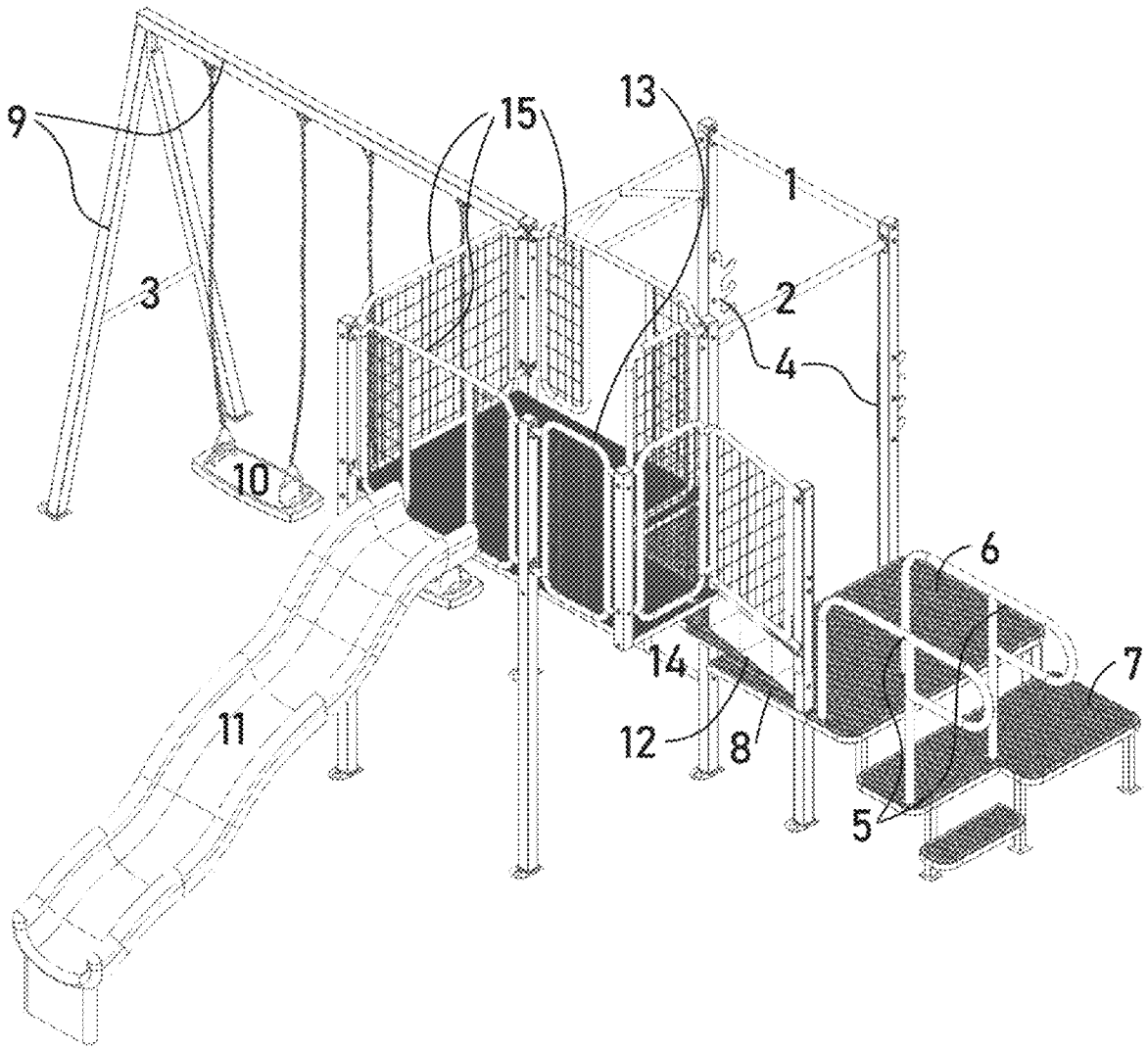
FIG. 2 is a rear perspective view of the fitness-based playset equipment shown in FIG. 1.

Referring to the figures, wherein like numerals indicate like or corresponding parts throughout the several views, FIGS. 1 and 2 depict opposite views of the playset with exercise features numbered 1-8 and children's play features numbered 9-15. Various components of the playset can be used for both play and exercise purposes.

Vertical support members are constructed of 2.5-inch tube steel with a plurality of apertures to generally accommodate 5/16-inch bolts. Each vertical support member has a steel foot welded perpendicular to the bottom of the tube steel with a 1.25-inch diameter aperture to accommodate a removable earth anchor. Each vertical support is capped.

Exercise features 1, 2, and 3 are pull-up bars at various heights. Part 1 is a pull-up bar at approximately 8-feet off the ground with a minimum uninterrupted span of 24-inches, a size suitable for use by taller adults and teens. When accessed from the adjacent platform 5, part 2 is a 6-foot high pull-up bar, with a minimum uninterrupted span of 24-inches, which is suitable for use by shorter adults and youth. Part 3 is a youth pull-up apparatus at approximately 3 feet above ground level with a minimum uninterrupted width of 20-inches, a suitable size for small children to use. Part 3 can also be used for various other athletic and stretching maneuvers, such as those found in barre and yoga practices. Pull-up bars 1, 2, and 3 are all constructed of 1.315-inch diameter pipe and coated in a non-slip, durable polymer coating for comfortable use and may or may not have a knurled texture. Gymnastics rings, resistance bands, and other suspension exercise systems can be attached to pull-up bars 1, 2, or 3 in a variety of configurations to provide additional strength training exercises.

Part 4 depicts a gun-rack style bar holder to accommodate strength training exercises that use a barbell, commonly referred to as a squat rack which is intended for adult use. Part 4 is attached to the vertical support posts by six bolts and may be removed.

Part 5 depicts dip bars used for many strength training exercises. The bars may be installed 27.5-inches above platform 6 and 36.25-inches above platform 7, allowing for various uses and users. The horizontal members of the dip bars are laterally spaced between 18-inches and 25-inches. The bars may or may not have a knurled texture. The dip bars (part 5) double as a handrail for the steps up to the top of platform 6. Dip bars (part 5) are constructed of tubing with a diameter between 1-inch and 2-inch and coated in a non-slip, durable polymer coating for comfortable use.

Platforms 6 and 7 are sized to serve as box jumps, another essential piece of equipment for strength training exercises. Platform 6 may measure 24-inches from the ground, which is a suitable height for taller or more advanced users. Platform 7 may measure 16-inches from the ground, which is a suitable height for shorter adults and youth. The depth of both platforms 6 and 7 allow ample space clear space, measuring a minimum of 22-inches in depth by 66-inches in height, for the user to jump up on the platform without hitting any obstructions. The platform deck is constructed of perforated sheet steel to provide a sturdy surface upon which the user can perform exercises.

Part 8 depicts the foot hold integrated into the staircase allowing for a place to conduct abdominal exercises, such as crunches. The user can lay on platform 6 and hook their feet in the slot 8 for added stability. This is referred to as the core training station.

Figure 3:
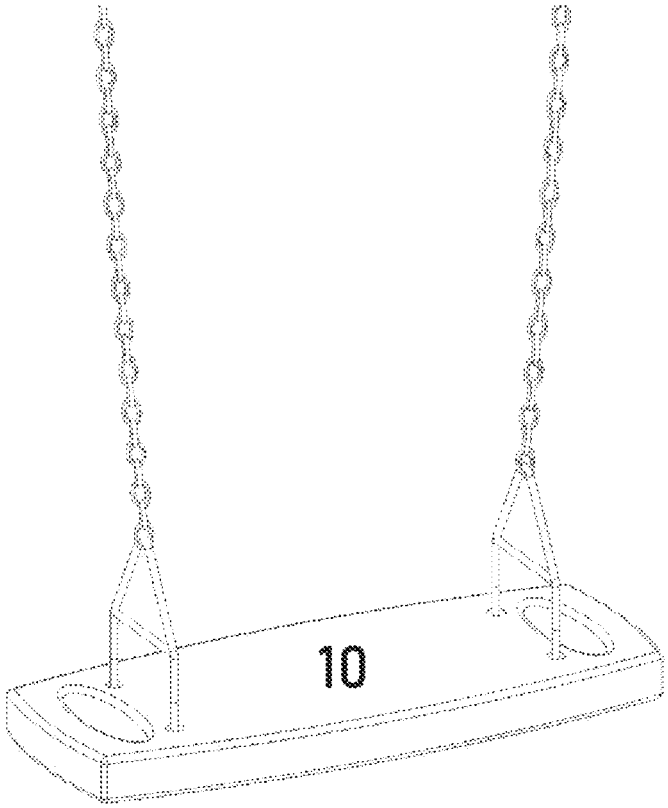
FIG. 3 depicts a unique dual purpose swing seat with integrated hand grips allowing users to conduct core training exercises in addition to the typical use as a swing.

Parts 9, 10, 11, 12, 13, 14, and 15 depict the various components of the playset aimed primarily to accommodate children's play. Part 9 is a conventional swing station designed to accommodate a variety of swing seats. Part 10 is a swing seat with integrated hand grips allowing users to conduct core training exercises. Refer to FIG. 3 for more detail on part 10. Part 11 is any of numerous designs of a plastic slide. Part 12 is a climbing staircase with adequate safety rails leading to part 13, the play deck. From the play deck 13, children can access the slide and climbing ladder, part 14. The play deck 13 is surrounded by adequate safety railings, parts 15.

Climbing ladder 14 and safety railings 15 are built with a specific and consistent bolt pattern to allow parts to be interchangeable.

FIG. 3 shows a detail view of a unique swing seat design, part 10, with integrated hand grips to allow users to conduct core training exercises. The integrated hand grips facilitate several workout exercises while retaining all functionality and comfort of a typical rigid swing seat. To conduct the strength exercises, the user faces the swing seat and places their thumbs in the aperture and palms on the plastic seat.

Figure 4:
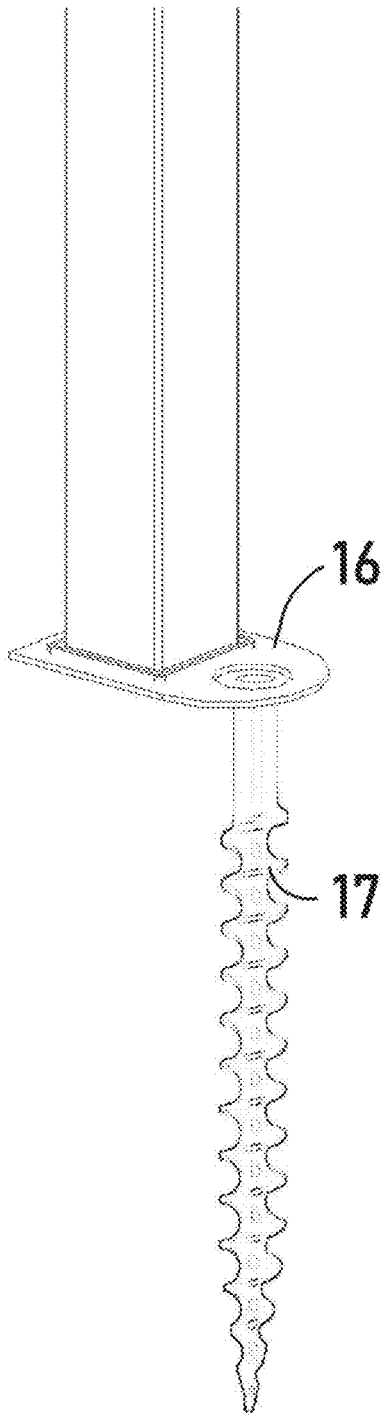
FIG. 4 is a detail view of a typical post foot and earth anchor attachment.

FIG. 4 shows a detail view of the foot of each vertical support member, part 16, and corresponding earth anchor, part 17. Vertical supports have a flat horizontal foot with a 1.25-inch diameter aperture to receive a removeable screw-style earth anchor allowing the entirety of the equipment to be secured in place. Earth anchors also allow the equipment to be disassembled and reassembled in a different location without causing damage to the structure.

Figure 5:
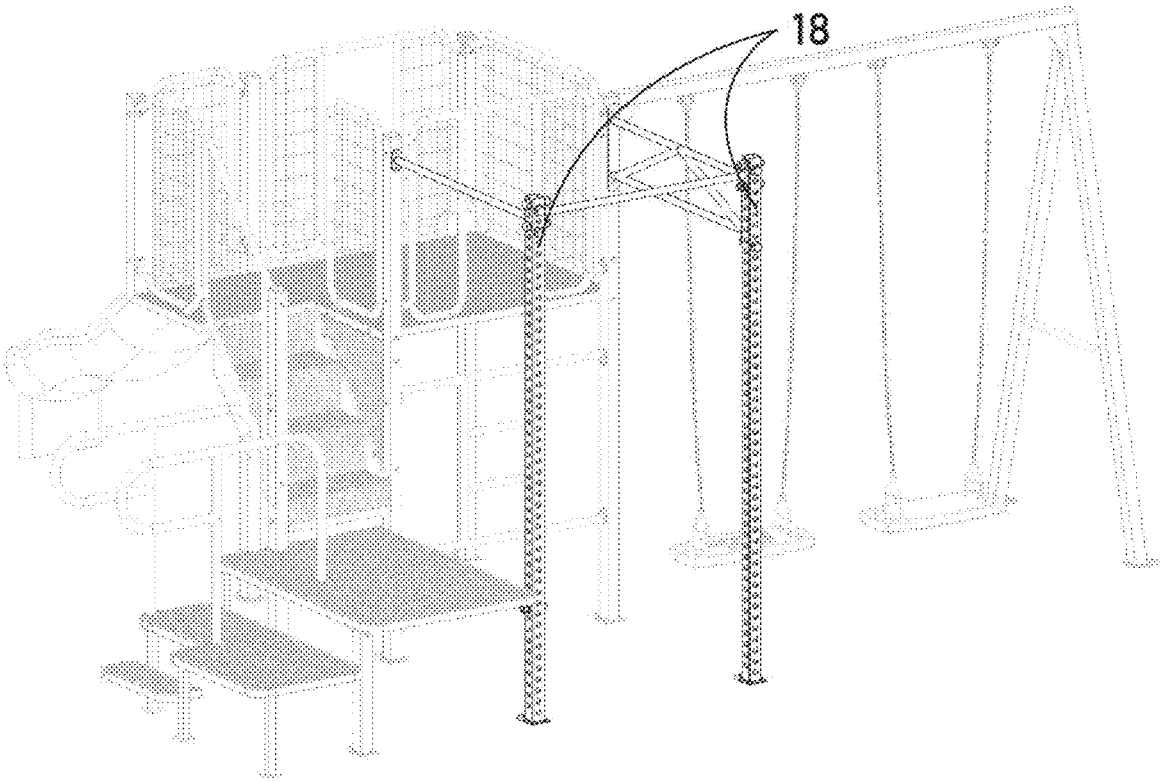
FIG. 5 is a detail view of alternative posts with holes throughout to accept bolts to accommodate the attachment of other equipment and accessories.

FIG. 5 shows an alternative pull-up bars and post assembly, collectively part 18, which can replace the previously depicted pull-up bars and post assembly. Vertical support members of part 16, constructed of tube steel, have a plurality of apertures to accommodate attachment of various exercise equipment sold by other manufacturers and widely available on the market.

Figure 6:
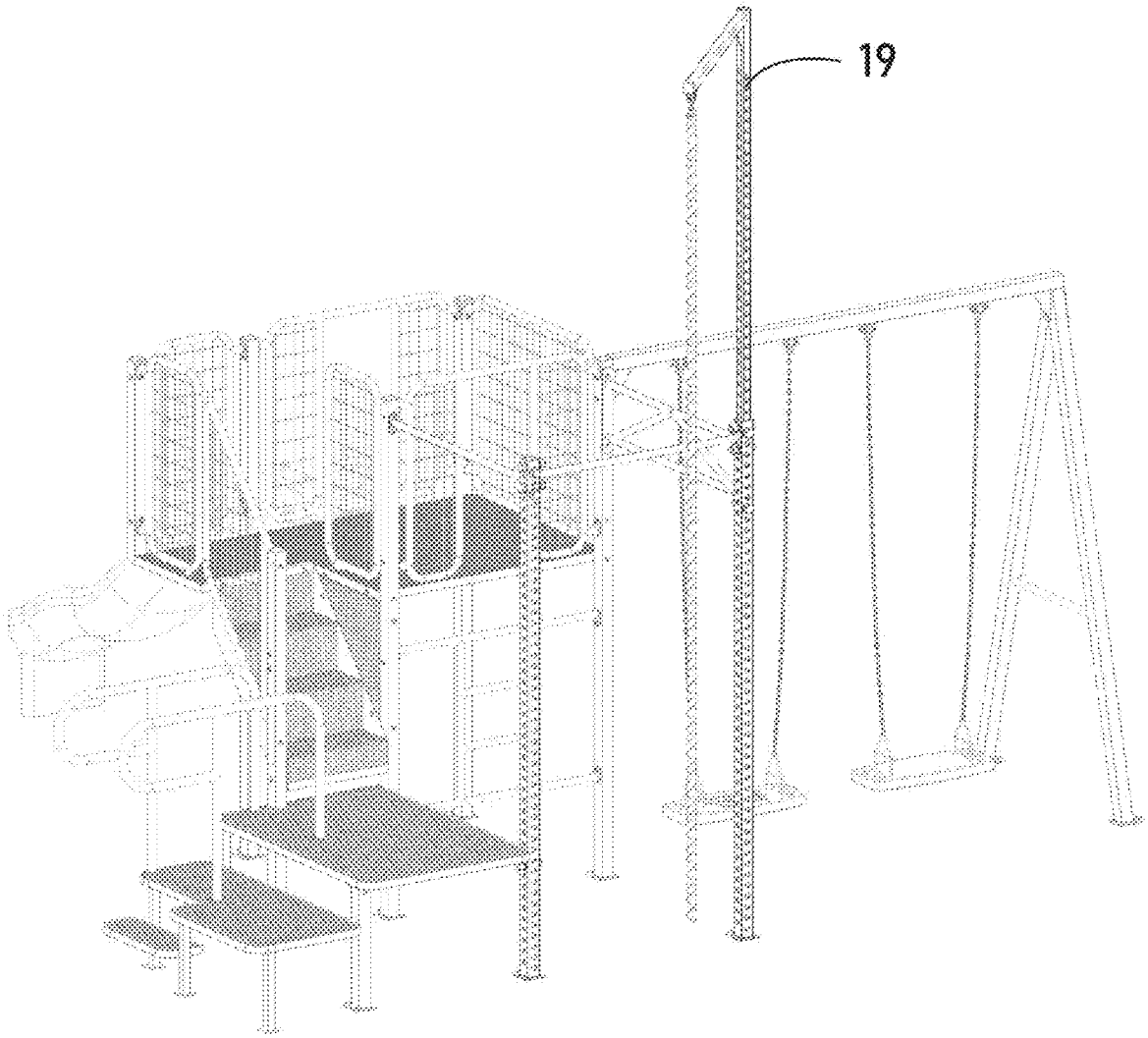
FIG. 6 depicts an adjustable apparatus to accommodate various suspension exercise attachments such as climbing ropes, rings, punching bags, etc.
Figure 7A:
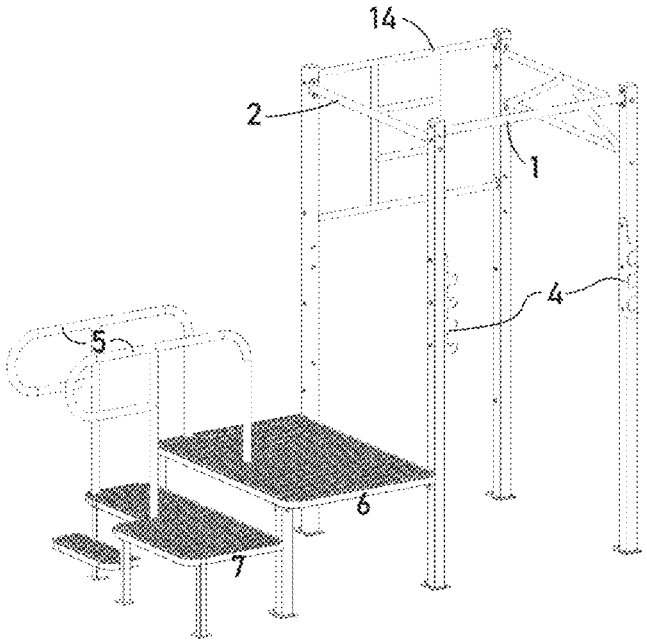
FIGS. 7A, 7B, 7C, 7D, 7E, 7F, and 7G show modular configurations of the fitness-based playset.
Figure 7B:
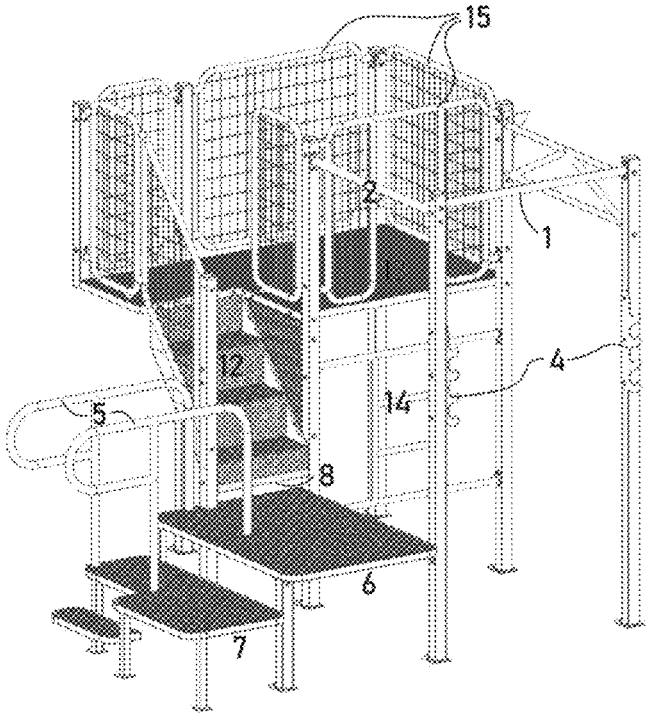
Figure 7C:
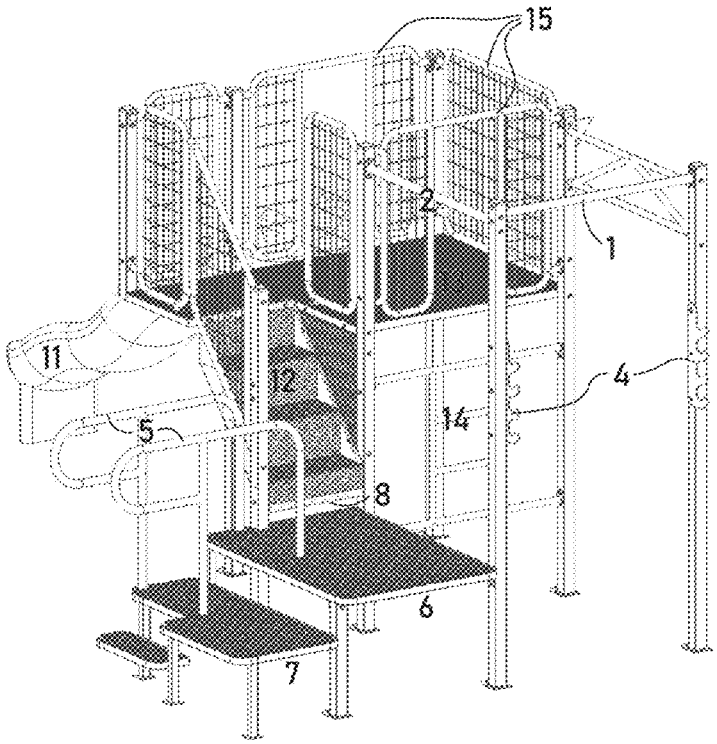
Figure 7D:
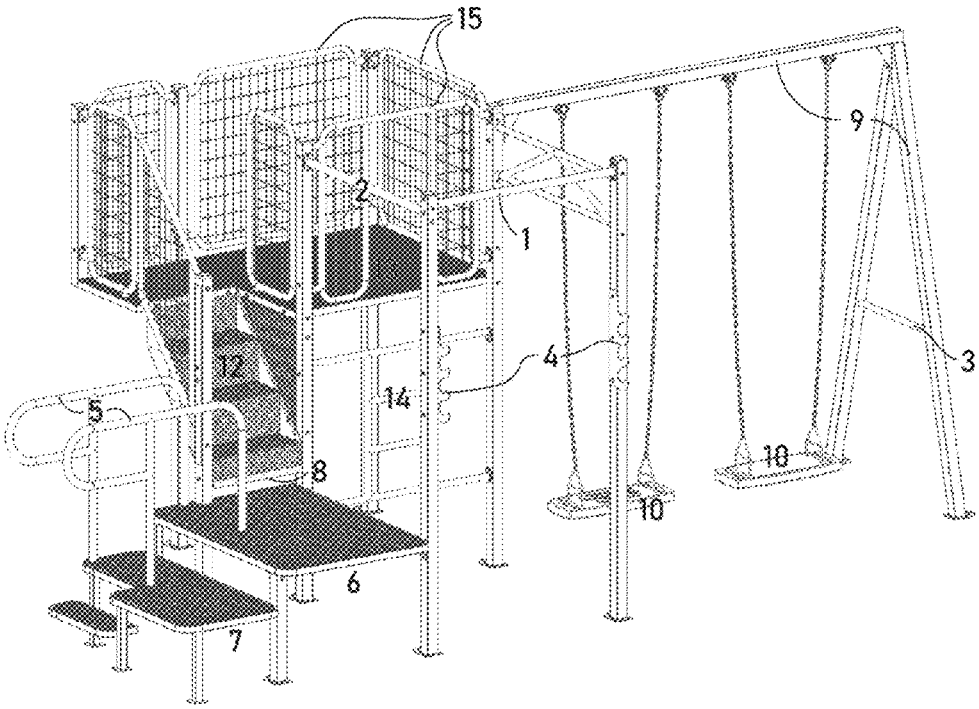
Figure 7E:
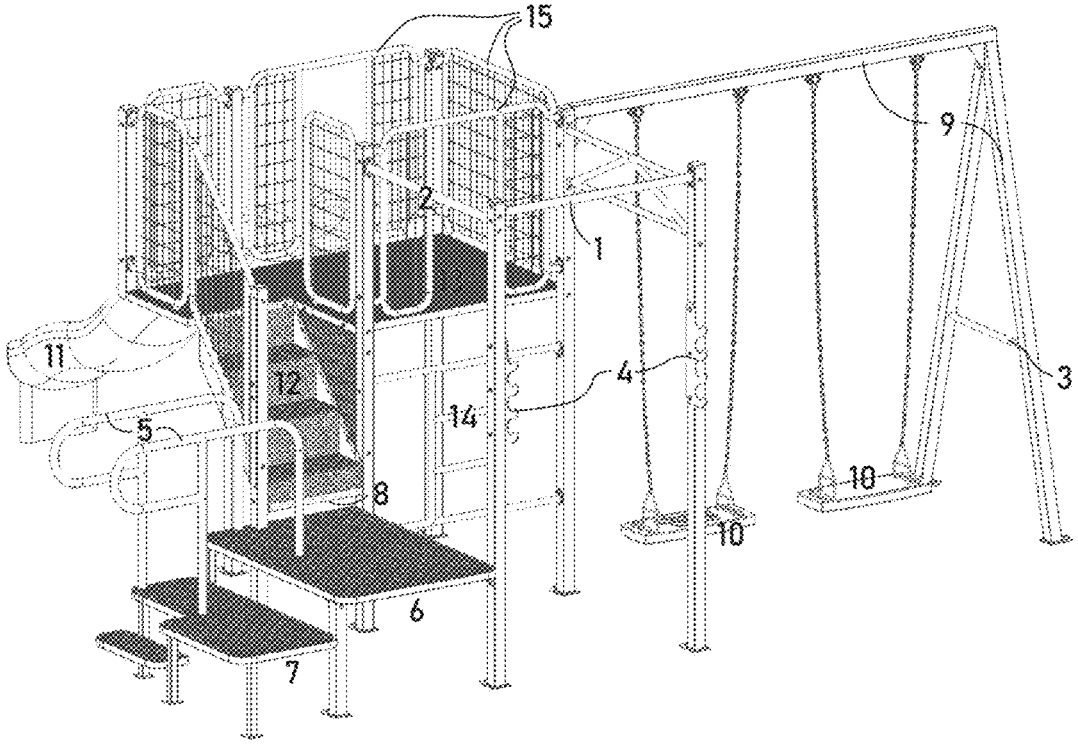
Figure 7F:
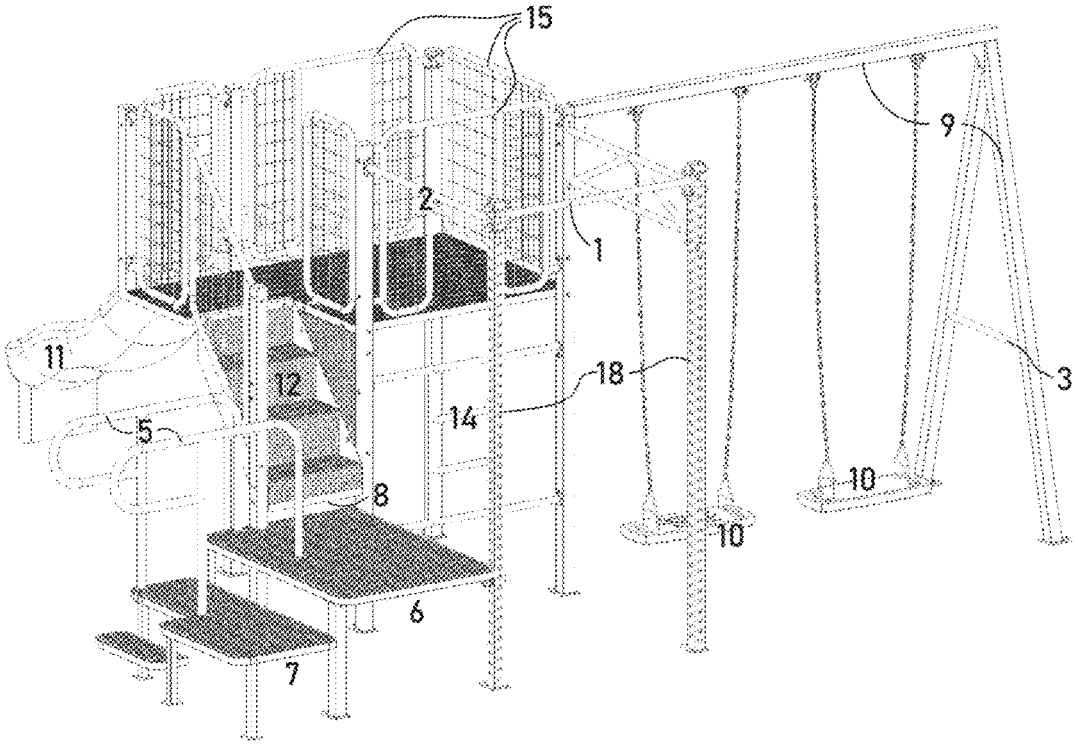
Figure 7G:
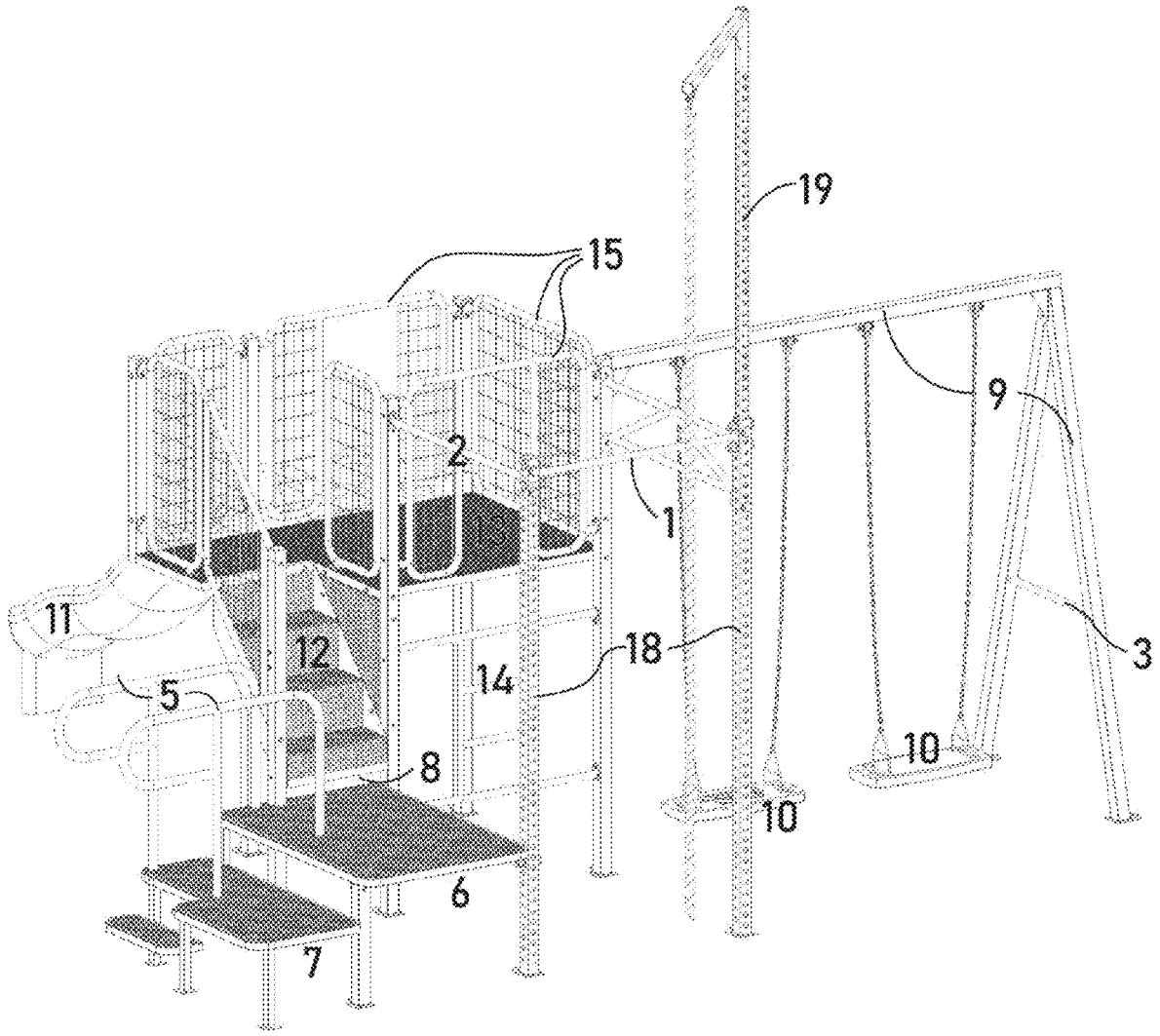

FIG. 6 shows an optional adjustable suspension apparatus, part 19, to accommodate various suspension exercise attachments such as climbing ropes, rings, punching bags, etc. Adjustable suspension apparatus can be added to part 16. The upright and horizontal portions of part 17 are constructed of ~2-inch tube steel with a plurality of apertures by which the height can be adjusted or other attachments added through the use of bolts, nuts, and washers.

FIGS. 7A, 7B, 7C, 7D, 7E, 7F, and 7G depict the various modular configurations of the playset with each workout or play feature labeled as such. Consumers can configure the workout and play features to suit their specific needs at a certain time, with the potential to add additional play or workout features. The configuration shown in FIG. 7A includes parts 1, 2, optional part 4, 5, 6, and 7. The configuration shown in FIG. 7B includes parts 1, 2, optional part 4, 5, 6, 7, 8, 12, 13, 14, and 15. The configuration shown in FIG. 7C includes parts 1, 2, optional part 4, 5, 6, 7, 8, 11, 12, 13, 14, and 15. The configuration shown in FIG. 7D includes parts 1, 2, 3, optional 4, 5, 6, 7, 8, 9, 10, 12, 13, 14, and 15. The configuration shown in FIG. 7E includes parts 1, 2, 3, optional part 4, 5, 6, 7, 8, 9, 10, 11, 12, 13, 14, and 15. The configuration shown in FIG. 7F includes parts 1, 2, 3, 5, 6, 7, 8, 9, 10, optional part 11, 12, 13, 14, 15 and the alternative post assembly, part 18. The configuration shown in FIG. 7G includes parts 1, 2, 3, 5, 6, 7, 8, 9, 10, optional part 11, 12, 13, 14, 15, part 18 (the alternative post assembly) and part 19 (the adjustable suspension apparatus).

The foregoing invention has been described in accordance with the relevant legal standards, thus the description is exemplary rather than limiting in nature. Variations and modifications to the disclosed embodiment may become apparent to those skilled in the art and fall within the scope of the invention. Furthermore, particular features of one embodiment can replace corresponding features in another embodiment or can supplement other embodiments unless otherwise indicated by the drawings or this specification.

What is claimed is:

1. Fitness equipment with integrated play equipment comprising:

a freestanding support structure comprising:

a plurality of vertical supports including:

a plurality of apertures adapted to removably receive a first support bracket and second support bracket configured to removably receive and support a barbell; and a plurality of apertures that extend through the vertical supports adapted to removably receive a plurality of horizontal cross members; and a plurality of horizontal cross members attached to the vertical supports with apertures to allow for overall stability; and a platform system supported by and connected to the freestanding support structure via an aperture extending through each of a first and second vertical support of the plurality of vertical supports such that the first support bracket is removably received on a first side of at least one of the two of the vertical supports and the platform system having a plurality of platforms arranged at decreasing heights is attached on an opposing side of at least one of the two of the vertical supports and having supports configured to be supported on a ground surface to provide a rigid system capable of supporting dynamic forces associated with fitness and play features; two supports attached to said platform system and configured at heights and spacing configured to serve as dip bars for exercise moves and serve as a handrail for steps leading to play features; wherein said platform system is configured is oriented to allow a user to perform box jump exercises as well as steps;

and a plurality of play equipment features attached to said freestanding support structure comprising at least one of a swing structure comprising:

a seat; and a horizontal bar; and a vertical support structure; and a slide.

2. The equipment as in claim 1, further wherein the first vertical support member and the second vertical support member connected by a horizontal cross member at heights configured to serve as pull up bars that allow for full body swinging motion.

3. The equipment as in claim 1, wherein the vertical supports may include a plurality of apertures adapted to removably receive various fitness attachments.

4. The equipment as in claim 1, further comprising a horizontal platform connected to the freestanding support structure and perpendicular to an adjacent vertical plane which has an opening configured at heights to allow the users feet to be inserted to provide stability when performing core exercise moves.

5. The equipment as in claim 1, wherein each of the plurality of vertical supports have a horizontal foot with a hole to receive a removeable earth anchor allowing the entirety of the equipment to be secured and also allowing the entirety of the equipment to be disassembled and reassembled in a different location.

6. The equipment as in claim 1, further comprising a plurality of removable barriers and equipment components being sized and configured to be interchangeably connected to the freestanding support structure in a variety of positions for maximum versatility for the end user; wherein the barriers are designed to reinforce the freestanding support structure against dynamic forces of adult exercise and adult use of play features.

7. The equipment as in claim 1, further comprising a removable vertical and horizontal member from which various suspension exercise equipment may be hung from a height of over 8 feet.

8. The equipment as in claim 1, further comprising a modular design wherein a base structure of the equipment comprises four vertical supports of the plurality of vertical supports, five horizontal cross members of the plurality of cross members, and the platform structure and is structurally sound independent from additional equipment; and said additional equipment including two additional vertical supports, a plurality of barriers with horizontal cross members, and a platform; and a horizontal bar and A-frame vertical support attached to the freestanding support structure configuration to provide a place from which to hang swings.

9. The equipment as in claim 1, wherein the plurality of vertical supports include a plurality of apertures configured to receive a variety of climbing apparatus designed for use by children and adults.

* * * * *